US007972064B2

(12) United States Patent
Anderson

(10) Patent No.: US 7,972,064 B2
(45) Date of Patent: Jul. 5, 2011

(54) ONE WAY VALVE AND CONTAINER

(75) Inventor: Brent Anderson, Barrington, IL (US)

(73) Assignee: CTI Industries Corporation, Barrington, IL (US)

( * ) Notice: Subject to any disclaimer, the term of this patent is extended or adjusted under 35 U.S.C. 154(b) by 1061 days.

(21) Appl. No.: 11/092,384

(22) Filed: Mar. 29, 2005

(65) Prior Publication Data

US 2006/0131328 A1 Jun. 22, 2006

Related U.S. Application Data

(63) Continuation-in-part of application No. 11/020,380, filed on Dec. 22, 2004, now Pat. No. 7,398,953.

(51) Int. Cl.
*B65D 33/01* (2006.01)
*B65D 33/00* (2006.01)
*F16K 31/44* (2006.01)

(52) U.S. Cl. ..... 383/103; 383/105; 251/82

(58) Field of Classification Search ..... 383/103, 383/105, 80, 44; 251/82, 149.2; 137/246
See application file for complete search history.

(56) References Cited

U.S. PATENT DOCUMENTS

| | | | |
|---|---|---|---|
| 336,826 | A | 2/1886 | Steeneken |
| 972,095 | A | 10/1910 | Booth |
| 1,109,110 | A | 9/1914 | Clark |
| 1,884,215 | A | 2/1932 | Edwards |
| 2,024,908 | A | 12/1935 | Blum |
| 2,027,290 | A | 1/1936 | Reach |
| 2,106,671 | A | 1/1938 | Watson |
| 2,116,009 | A | 5/1938 | Brown |
| 2,133,411 | A | 10/1938 | Zohe |
| 2,196,708 | A | 4/1940 | Reid |
| 2,392,594 | A | 1/1946 | Karfiol et al. |
| 2,477,300 | A | 7/1949 | Karfiol et al. |
| 2,569,975 | A | 10/1951 | Cone |
| 2,643,027 | A | 6/1953 | Fink |
| 2,659,516 | A | 11/1953 | Smith |
| 2,672,268 | A | 3/1954 | Bower |
| 2,697,635 | A | 12/1954 | Ivins et al. |

(Continued)

FOREIGN PATENT DOCUMENTS

| | | |
|---|---|---|
| DE | 2332927 | 9/1984 |

(Continued)

OTHER PUBLICATIONS

Brubaker et al. "The Coil Test and Neutrophil Stimulation Pack" (1977).

*Primary Examiner* — Jes F Pascua
(74) *Attorney, Agent, or Firm* — Joseph A. Fuchs; Rockey, Depke & Lyons

(57) ABSTRACT

The present invention provides a one way valve having a valve body, a wall, a fluid inlet, and a fluid outlet. The valve has a plunger which is moveable with respect to the valve body from a first position to a second position. The valve also has a diaphragm positioned in the valve body for movement between a third position and a fourth position when the plunger is in the first position. When the diaphragm is in the third position the fluid outlet is closed and when the diaphragm is in the fourth position the fluid outlet is open.

9 Claims, 10 Drawing Sheets

U.S. PATENT DOCUMENTS

| | | | | |
|---|---|---|---|---|
| 2,714,557 | A | | 8/1955 | Mahaffy |
| 2,731,297 | A | | 1/1956 | Meyer |
| 2,736,468 | A | | 2/1956 | Hills |
| 2,778,171 | A | | 1/1957 | Taunton |
| 2,778,173 | A | | 1/1957 | Taunton |
| 2,804,257 | A | | 8/1957 | Hasler et al. |
| 2,809,800 | A | | 10/1957 | Ahl |
| 2,859,899 | A | | 11/1957 | Kramer et al. |
| 2,862,648 | A | | 12/1958 | Cooksley et al. |
| 2,870,954 | A | | 1/1959 | Kulesza |
| 2,885,084 | A | | 5/1959 | Rocca |
| 2,891,700 | A | | 6/1959 | Maynard |
| 2,920,798 | A | | 1/1960 | Samuel |
| 3,063,461 | A | | 11/1962 | Rudolph |
| 3,081,911 | A | | 3/1963 | Scholle |
| 3,083,875 | A | | 4/1963 | Welty et al. |
| 3,090,526 | A | | 5/1963 | Hamilton et al. |
| 3,110,754 | A | | 11/1963 | Witort et al. |
| 3,112,047 | A | | 11/1963 | Weinreich et al. |
| 3,142,599 | A | | 7/1964 | Chavannes |
| 3,171,571 | A | | 3/1965 | Daniels |
| 3,176,727 | A | | 4/1965 | Rousseau |
| 3,197,073 | A | | 7/1965 | Gondra et al. |
| 3,203,026 | A | | 8/1965 | Schwartzmann |
| 3,204,825 | A | | 9/1965 | Underwood |
| 3,212,681 | A | | 10/1965 | Weikert |
| 3,219,240 | A | | 11/1965 | Campbell, Jr. |
| 3,240,399 | A | | 3/1966 | Frandeen |
| 3,244,576 | A | | 4/1966 | Swartz |
| 3,254,828 | A | | 6/1966 | Lerner |
| 3,257,036 | A | | 6/1966 | Micallef |
| 3,260,412 | A | | 7/1966 | Larkin |
| 3,334,659 | A | | 8/1967 | Magorien |
| 3,342,377 | A | | 9/1967 | Peredy |
| 3,361,303 | A | | 1/1968 | Jacuzzi |
| 3,366,284 | A | | 1/1968 | Marona |
| 3,367,380 | A | | 2/1968 | Dickey |
| 3,411,698 | A | | 11/1968 | Reynolds |
| 3,420,413 | A | | 1/1969 | Corsette |
| 3,456,850 | A | | 7/1969 | Uhlmann |
| 3,469,796 | A | | 9/1969 | Guenther |
| 3,549,050 | A | | 12/1970 | Bruce et al. |
| 3,587,794 | A | | 6/1971 | Mattel |
| 3,666,182 | A | | 5/1972 | Cureton |
| 3,695,314 | A | | 10/1972 | Watts et al. |
| 3,718,236 | A | | 2/1973 | Reyner et al. |
| 3,799,914 | A | | 3/1974 | Schmit |
| 3,809,217 | A | | 5/1974 | Harrison |
| 3,838,794 | A | | 10/1974 | Cogley et al. |
| 3,881,519 | A | | 5/1975 | Zahid |
| 3,887,072 | A | | 6/1975 | Koremura |
| 3,902,516 | A | | 9/1975 | Rudolph |
| 3,946,780 | A | | 3/1976 | Sellers |
| 3,949,934 | A | * | 4/1976 | Goglio ..... 383/103 |
| 3,958,693 | A | | 5/1976 | Greene |
| 3,981,415 | A | | 9/1976 | Fowler et al. |
| 3,988,499 | A | | 10/1976 | Reynolds |
| 4,014,461 | A | | 3/1977 | Harvill |
| 4,015,819 | A | | 4/1977 | Zahid |
| 4,041,209 | A | | 8/1977 | Scholle |
| 4,062,475 | A | | 12/1977 | Harris et al. |
| 4,087,026 | A | | 5/1978 | Petterson |
| 4,093,068 | A | | 6/1978 | Smrt |
| 4,137,930 | A | | 2/1979 | Scholle |
| 4,138,036 | A | | 2/1979 | Bond |
| 4,148,416 | A | | 4/1979 | Gunn-Smith |
| 4,150,696 | A | | 4/1979 | Meier et al. |
| 4,152,184 | A | | 5/1979 | Bacehowski |
| 4,159,790 | A | | 7/1979 | Bailey |
| 4,193,518 | A | | 3/1980 | Holmes |
| 4,214,675 | A | | 7/1980 | Schmit |
| 4,224,367 | A | | 9/1980 | Scholle |
| 4,257,535 | A | | 3/1981 | Mellett |
| 4,258,863 | A | | 3/1981 | Ness |
| 4,265,373 | A | | 5/1981 | Stoody |
| 4,266,692 | A | | 5/1981 | Clark |
| 4,269,884 | A | | 5/1981 | Della Vecchia et al. |
| 4,270,533 | A | | 6/1981 | Andreas |
| 4,275,823 | A | | 6/1981 | Credle, Jr. |
| 4,284,671 | A | | 8/1981 | Cancio et al. |
| 4,286,636 | A | | 9/1981 | Credle |
| 4,322,020 | A | | 3/1982 | Stone |
| 4,326,574 | A | | 4/1982 | Palaroni et al. |
| 4,362,255 | A | | 12/1982 | Bond |
| 4,375,864 | A | | 3/1983 | Savage |
| 4,381,846 | A | | 5/1983 | Heck |
| 4,445,539 | A | | 5/1984 | Credle |
| 4,445,550 | A | | 5/1984 | Davis et al. |
| 4,449,243 | A | | 5/1984 | Platel |
| 4,484,697 | A | | 11/1984 | Fry, Jr. |
| 4,513,884 | A | | 4/1985 | Magid |
| 4,524,458 | A | | 6/1985 | Pongrass et al. |
| 4,551,379 | A | | 11/1985 | Kerr |
| 4,564,132 | A | * | 1/1986 | Lloyd-Davies ..... 222/522 |
| 4,576,283 | A | | 3/1986 | Fafournoux |
| 4,579,756 | A | | 4/1986 | Edgel |
| 4,600,130 | A | | 7/1986 | Libit |
| 4,601,410 | A | | 7/1986 | Bond |
| 4,683,702 | A | | 8/1987 | Vis |
| 4,756,422 | A | | 7/1988 | Kristen |
| 4,815,631 | A | | 3/1989 | Eeg et al. |
| 4,893,731 | A | | 1/1990 | Richter |
| 5,006,056 | A | | 4/1991 | Mainstone et al. |
| 5,024,354 | A | | 6/1991 | Ledewiz |
| 5,067,208 | A | | 11/1991 | Herrington, Jr. et al. |
| 5,088,971 | A | | 2/1992 | Herrington |
| 5,131,121 | A | | 7/1992 | Herrington, Jr. et al. |
| 5,147,071 | A | | 9/1992 | Rutter |
| 5,161,286 | A | | 11/1992 | Herrington, Jr. et al. |
| 5,203,458 | A | | 4/1993 | Cornwell |
| 5,232,535 | A | | 8/1993 | Brinley |
| 5,385,564 | A | | 1/1995 | Slater |
| RE34,929 | E | | 5/1995 | Kristen |
| 5,442,837 | A | | 8/1995 | Morgan |
| 5,450,963 | A | | 9/1995 | Carson |
| 5,540,557 | A | * | 7/1996 | Carson ..... 417/53 |
| 5,647,511 | A | | 7/1997 | Bond |
| 5,701,996 | A | | 12/1997 | Goto et al. |
| 5,728,086 | A | | 3/1998 | Niedospial, Jr. |
| 5,743,435 | A | | 4/1998 | Tomic |
| 5,749,493 | A | | 5/1998 | Boone et al. |
| 5,836,056 | A | | 11/1998 | Porchia et al. |
| 5,915,596 | A | | 6/1999 | Credle, Jr. |
| 5,924,173 | A | | 7/1999 | Dobreski et al. |
| 5,928,762 | A | | 7/1999 | Aizawa et al. |
| 5,941,421 | A | | 8/1999 | Overman et al. |
| 5,950,285 | A | | 9/1999 | Porchia et al. |
| 6,010,244 | A | | 1/2000 | Dobreski et al. |
| 6,012,611 | A | | 1/2000 | Schroeder |
| 6,033,113 | A | | 3/2000 | Anderson |
| 6,036,364 | A | | 3/2000 | Heuvel |
| 6,045,006 | A | | 4/2000 | Frazier et al. |
| 6,071,011 | A | | 6/2000 | Thomas et al. |
| 6,073,807 | A | | 6/2000 | Wilford et al. |
| 6,074,096 | A | | 6/2000 | Tilman |
| 6,092,931 | A | | 7/2000 | Tilman |
| 6,102,252 | A | | 8/2000 | Overman et al. |
| 6,131,248 | A | | 10/2000 | Tomic |
| 6,152,600 | A | | 11/2000 | Tomic |
| 6,156,363 | A | | 12/2000 | Chen et al. |
| 6,161,271 | A | | 12/2000 | Schreiter |
| 6,164,826 | A | | 12/2000 | Petkovsek |
| 6,179,173 | B1 | | 1/2001 | Frazier et al. |
| 6,199,256 | B1 | | 3/2001 | Revnew et al. |
| 6,210,038 | B1 | | 4/2001 | Tomic |
| 6,217,215 | B1 | | 4/2001 | Tomic |
| 6,223,981 | B1 | | 5/2001 | Gunder |
| 6,231,236 | B1 | | 5/2001 | Tilman |
| 6,247,843 | B1 | | 6/2001 | Buchman |
| 6,247,844 | B1 | | 6/2001 | Tomic et al. |
| 6,264,366 | B1 | | 7/2001 | Custer |
| 6,273,607 | B1 | | 8/2001 | Buchman |
| 6,286,999 | B1 | | 9/2001 | Cappel et al. |
| 6,287,000 | B1 | | 9/2001 | Buchman |
| 6,287,001 | B1 | | 9/2001 | Buchman |
| 6,290,390 | B1 | | 9/2001 | Buchman |
| 6,290,391 | B1 | | 9/2001 | Buchman |

| | | | | |
|---|---|---|---|---|
| 6,290,393 | B1 | 9/2001 | Tomic | |
| 6,306,071 | B1 | 10/2001 | Tomic | |
| 6,327,754 | B1 | 12/2001 | Belmont et al. | |
| 6,347,885 | B1 | 2/2002 | Buchman | |
| 6,357,915 | B2 | 3/2002 | Anderson | |
| 6,361,209 | B1 | 3/2002 | LaRue et al. | |
| 6,361,211 | B1 | 3/2002 | Tilman | |
| 6,364,530 | B1 | 4/2002 | Buchman | |
| 6,376,035 | B1 | 4/2002 | Dobreski et al. | |
| 6,386,760 | B1 | 5/2002 | Tomic | |
| 6,402,375 | B1 | 6/2002 | Schreiter et al. | |
| 6,409,066 | B1 | 6/2002 | Schneider et al. | |
| 6,409,384 | B1 | 6/2002 | Provan et al. | |
| 6,419,391 | B2 | 7/2002 | Thomas | |
| 6,439,770 | B2 | 8/2002 | Catchman | |
| 6,450,686 | B1 | 9/2002 | May | |
| 6,461,042 | B1 | 10/2002 | Tomic et al. | |
| 6,467,956 | B1 | 10/2002 | Tilman et al. | |
| 6,470,551 | B1 | 10/2002 | Provan et al. | |
| 6,474,866 | B2 | 11/2002 | Buchman | |
| 6,481,890 | B1 | 11/2002 | VandenHeuvel et al. | |
| 6,491,432 | B2 | 12/2002 | May | |
| 6,499,878 | B1 | 12/2002 | Dobreski et al. | |
| 6,500,559 | B2 | 12/2002 | Hofmeister et al. | |
| 6,517,242 | B1 | 2/2003 | Buchman | |
| 6,524,002 | B2 | 2/2003 | Tomic | |
| 6,527,444 | B1 | 3/2003 | Buchman | |
| 6,533,456 | B1 | 3/2003 | Buchman | |
| 6,533,884 | B1 | 3/2003 | Malik | |
| 6,572,266 | B2 | 6/2003 | Buchman | |
| 6,575,625 | B2 | 6/2003 | Cappel et al. | |
| 6,594,872 | B2 | 7/2003 | Cisek | |
| 6,604,634 | B2 | 8/2003 | Su | |
| 6,609,353 | B1 | 8/2003 | McMahon et al. | |
| 6,612,002 | B1 | 9/2003 | Savicki | |
| 6,622,353 | B2 | 9/2003 | Provan et al. | |
| 6,663,283 | B1 | 12/2003 | Cappel | |
| 6,686,005 | B2 | 2/2004 | White et al. | |
| 6,698,926 | B2 | 3/2004 | Buchman | |
| 6,709,157 | B2 | 3/2004 | VandenHeuvel et al. | |
| 6,712,334 | B2 * | 3/2004 | Motonaka et al. | 251/149.6 |
| 6,712,509 | B2 | 3/2004 | Cappel | |
| 6,712,510 | B2 | 3/2004 | Schneider et al. | |
| 6,713,152 | B2 | 3/2004 | Chen et al. | |
| 6,715,187 | B1 | 4/2004 | Wang | |
| 6,715,644 | B2 | 4/2004 | Wilford | |
| 6,733,622 | B2 | 5/2004 | McMahon et al. | |
| 6,743,330 | B2 | 6/2004 | Crevier | |
| 6,751,932 | B1 | 6/2004 | Matthews | |
| 6,796,015 | B2 | 9/2004 | Cortigiano, Sr. | |
| 6,799,680 | B2 | 10/2004 | Mak | |
| 6,804,935 | B2 | 10/2004 | Schneider et al. | |
| 6,810,639 | B1 | 11/2004 | McMahon et al. | |
| 6,810,641 | B2 | 11/2004 | Ausnit | |
| 6,810,642 | B2 | 11/2004 | Cortigiano, Sr. | |
| 6,811,528 | B1 | 11/2004 | Chen | |
| 6,817,763 | B2 | 11/2004 | Tomic | |
| 6,821,589 | B2 | 11/2004 | Dobreski et al. | |
| 6,840,675 | B2 | 1/2005 | Knight | |
| 6,840,897 | B2 | 1/2005 | Knight | |
| 6,842,973 | B2 | 1/2005 | Share et al. | |
| 6,843,600 | B2 | 1/2005 | Tilman et al. | |
| 6,846,108 | B2 | 1/2005 | Buchman | |
| 6,846,544 | B2 | 1/2005 | Buchman | |
| 6,854,887 | B2 | 2/2005 | Anderson | |
| 6,863,645 | B2 | 3/2005 | Crunkleton et al. | |
| 6,866,420 | B2 | 3/2005 | Buchman | |
| 6,874,298 | B2 | 4/2005 | McMahon et al. | |
| 6,874,937 | B2 | 4/2005 | Ausnit | |
| 6,880,972 | B2 | 4/2005 | Plourde | |
| 6,880,973 | B2 | 4/2005 | Schneider et al. | |
| 6,883,210 | B1 | 4/2005 | Savicki | |
| 6,884,208 | B2 | 4/2005 | Haws | |
| 6,895,725 | B2 | 5/2005 | Cortigiano, Sr. | |
| 6,896,409 | B2 | 5/2005 | Plourde et al. | |
| 6,901,637 | B2 | 6/2005 | Machacek | |
| 6,902,091 | B2 | 6/2005 | Cortigiano, Sr. | |
| 6,904,735 | B2 | 6/2005 | McMahon et al. | |
| 6,948,849 | B2 | 9/2005 | Schreiter | |
| 7,008,106 | B2 | 3/2006 | Cappel | |
| 7,040,808 | B2 | 5/2006 | Rehwinkel et al. | |
| 7,232,108 | B2 * | 6/2007 | Motonaka et al. | 251/100 |
| 7,398,953 | B2 * | 7/2008 | Anderson | 251/82 |
| 7,475,864 | B2 * | 1/2009 | Tanaka | 251/82 |
| 7,513,481 | B2 * | 4/2009 | Su | 251/82 |
| 7,565,978 | B2 * | 7/2009 | Han | 206/524.8 |
| 2001/0053253 | A1 | 12/2001 | Buchman et al. | |
| 2002/0012479 | A1 | 1/2002 | Tomic | |
| 2002/0064320 | A1 | 5/2002 | May | |
| 2002/0064321 | A1 | 5/2002 | Schreiter | |
| 2002/0064322 | A1 | 5/2002 | May | |
| 2002/0076122 | A1 | 6/2002 | Buchman | |
| 2002/0090151 | A1 | 7/2002 | Skeens et al. | |
| 2002/0117215 | A1 | 8/2002 | Skeens et al. | |
| 2002/0196987 | A1 | 12/2002 | Tilman et al. | |
| 2003/0021499 | A1 | 1/2003 | Buchman | |
| 2003/0063820 | A1 | 4/2003 | Buchman | |
| 2003/0136798 | A1 | 7/2003 | Wilford | |
| 2003/0169949 | A1 | 9/2003 | Buchman | |
| 2003/0185945 | A1 | 10/2003 | Buchman | |
| 2003/0202718 | A1 | 10/2003 | Tomic | |
| 2003/0202720 | A1 | 10/2003 | VandenHeuvel et al. | |
| 2003/0223654 | A1 | 12/2003 | Gerrits | |
| 2003/0228075 | A1 | 12/2003 | Buchman | |
| 2004/0022461 | A1 | 2/2004 | Schreiter | |
| 2004/0037477 | A1 | 2/2004 | Buchman | |
| 2004/0065402 | A1 | 4/2004 | Knoerzer et al. | |
| 2004/0086206 | A1 | 5/2004 | Tomic | |
| 2004/0091179 | A1 | 5/2004 | Anderson | |
| 2004/0120610 | A1 | 6/2004 | Buchman | |
| 2004/0131283 | A1 | 7/2004 | Sprague et al. | |
| 2004/0136615 | A1 | 7/2004 | Tilman et al. | |
| 2004/0136617 | A1 | 7/2004 | Gerrits | |
| 2005/0036717 | A1 | 2/2005 | Wu et al. | |
| 2005/0036718 | A1 | 2/2005 | Wu et al. | |
| 2005/0036719 | A1 | 2/2005 | Wu et al. | |
| 2005/0063617 | A1 | 3/2005 | Tilman | |
| 2005/0063621 | A1 | 3/2005 | Kettner et al. | |
| 2005/0135710 | A1 | 6/2005 | Melchoir | |
| 2005/0147330 | A1 | 7/2005 | Lee | |
| 2005/0244084 | A1 | 11/2005 | Tilman et al. | |
| 2005/0286808 | A1 | 12/2005 | Zimmerman et al. | |
| 2005/0286810 | A1 | 12/2005 | Sprague et al. | |
| 2005/0286811 | A1 | 12/2005 | Sprague et al. | |
| 2005/0286812 | A1 | 12/2005 | Sprague et al. | |
| 2006/0003879 | A1 | 1/2006 | Buchman | |
| 2006/0029301 | A1 | 2/2006 | Schreiter | |
| 2006/0029302 | A1 | 2/2006 | Buchman | |
| 2006/0072854 | A1 | 4/2006 | Schreiter | |
| 2006/0104548 | A1 | 5/2006 | Schreiter | |
| 2006/0110079 | A1 | 5/2006 | Zimmerman et al. | |
| 2006/0120632 | A1 * | 6/2006 | Han | 383/103 |
| 2006/0133700 | A1 | 6/2006 | Cappel | |
| 2006/0171610 | A1 | 8/2006 | Buchman et al. | |
| 2006/0182371 | A1 | 8/2006 | Borchardt | |
| 2006/0193540 | A1 | 8/2006 | Borchardt | |
| 2006/0197042 | A1 * | 9/2006 | Kneer | 251/82 |
| 2006/0201576 | A1 * | 9/2006 | Domenig | 141/65 |
| 2007/0068841 | A1 * | 3/2007 | Tanaka | 206/524.8 |

FOREIGN PATENT DOCUMENTS

| | | | |
|---|---|---|---|
| EP | 1153974 | | 11/2001 |
| EP | 1 431 211 | A1 | 6/2004 |
| GB | 732761 | | 6/1955 |
| GB | 756093 | | 8/1956 |
| GB | 1473524 | | 5/1977 |
| JP | 01-139346 | | 5/1989 |
| JP | 09-131846 | | 5/1997 |
| WO | 83/01605 | | 5/1983 |
| WO | 85/04383 | | 10/1985 |
| WO | 86/00868 | | 2/1986 |
| WO | 00/18836 | A1 | 4/2000 |
| WO | 01/36276 | A2 | 5/2001 |

* cited by examiner

FIG. 3
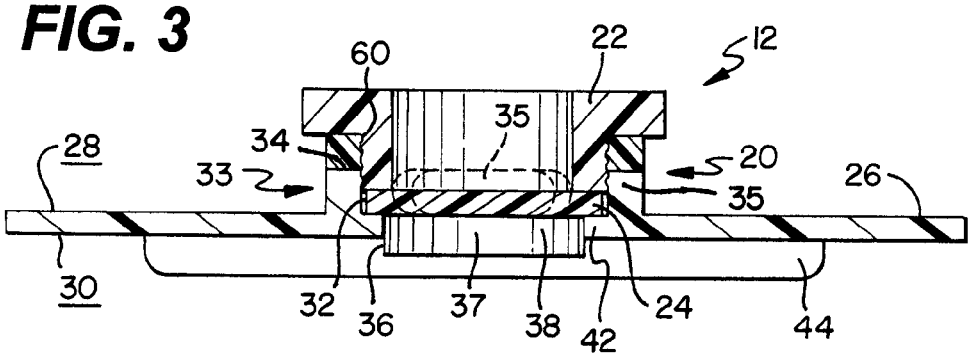
FIG. 4
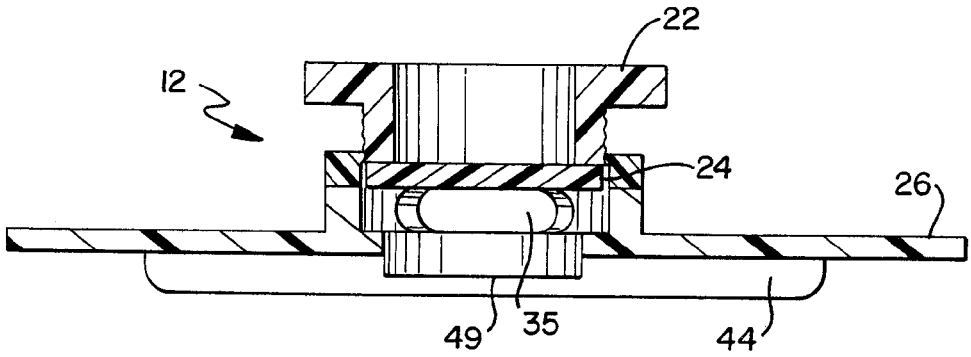
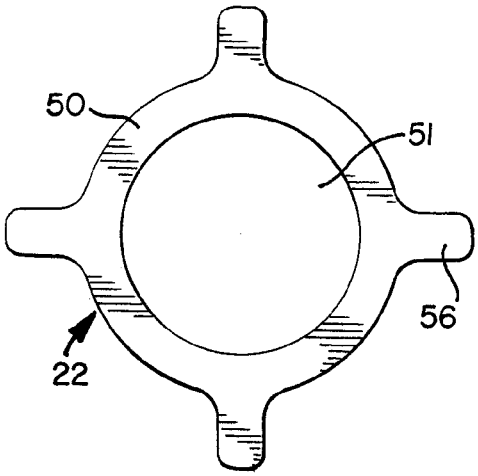
FIG. 5
FIG. 6
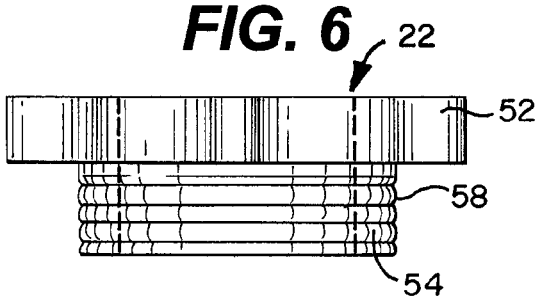

77
78
62
81
82
79
80
83
84
85
86
87
88
90
92
94
96
98
100
12
102
f

ONE WAY VALVE AND CONTAINER

CROSS-REFERENCE TO RELATED APPLICATION

This is a continuation-in-part of U.S. patent application Ser. No. 11/020,380, filed Dec. 22, 2004, now U.S. Pat. No. 7,398,953 which is incorporated herein by reference and made a part hereof.

FEDERALLY SPONSORED RESEARCH OR DEVELOPMENT

Not Applicable.

BACKGROUND OF THE INVENTION

1. Technical Field

The present invention relates to a container system for storing articles in a reduced air environment.

2. Background Art

Collapsible, evacuable storage containers typically include a flexible, fluid-tight bag, an opening through which to place an article in the bag, and a fixture through which to evacuate excess air. A user places an article into the enclosure through the opening, seals the opening, and then evacuates the fluid through the fixture. With the chamber thus evacuated, the article contained therein may be significantly compressed, so that it is easier to transport and requires substantially less storage space. For articles of food, storage life can be increased by removing air from the container and by maintaining this reduced oxygen environment.

Collapsible, evacuable storage containers are beneficial for reasons in addition to those associated with compression of the stored article. For example, removal of the air from the storage container inhibits the growth of destructive organisms, such as moths, silverfish, and bacteria, which require oxygen to survive and propagate. Moreover, such containers, being impervious to moisture, inhibit the growth of mildew.

One such container was developed by James T. Cornwell (U.S. Pat. No. 5,203,458). That patent described a disposable, evacuable container for sealing and compressing contaminated surgical garments for ease of storage and transportation prior to disposal.

Another such enclosure is described in a patent to Akihiro Mori and Ichiro Miyawaki (Japanese Pat. No. 01-139346). In that device, the opening through which the stored article is placed requires the application of a heat source, such as a home iron, to form an effective seal.

These and other aspects and attributes of the present invention will be discussed with reference to the following drawings and accompanying specification.

BRIEF DESCRIPTION OF THE DRAWINGS

FIG. 3 is a cross-sectional view of an embodiment of a valve of the present invention in a closed position;

FIG. 4 is a cross-sectional view of an embodiment of a valve of the present invention in an open position;

FIG. 5 is a top view of an embodiment of a plunger of the present invention;

FIG. 6 is a side view of the plunger shown in FIG. 5;

DETAILED DESCRIPTION OF THE INVENTION

Figure 1:
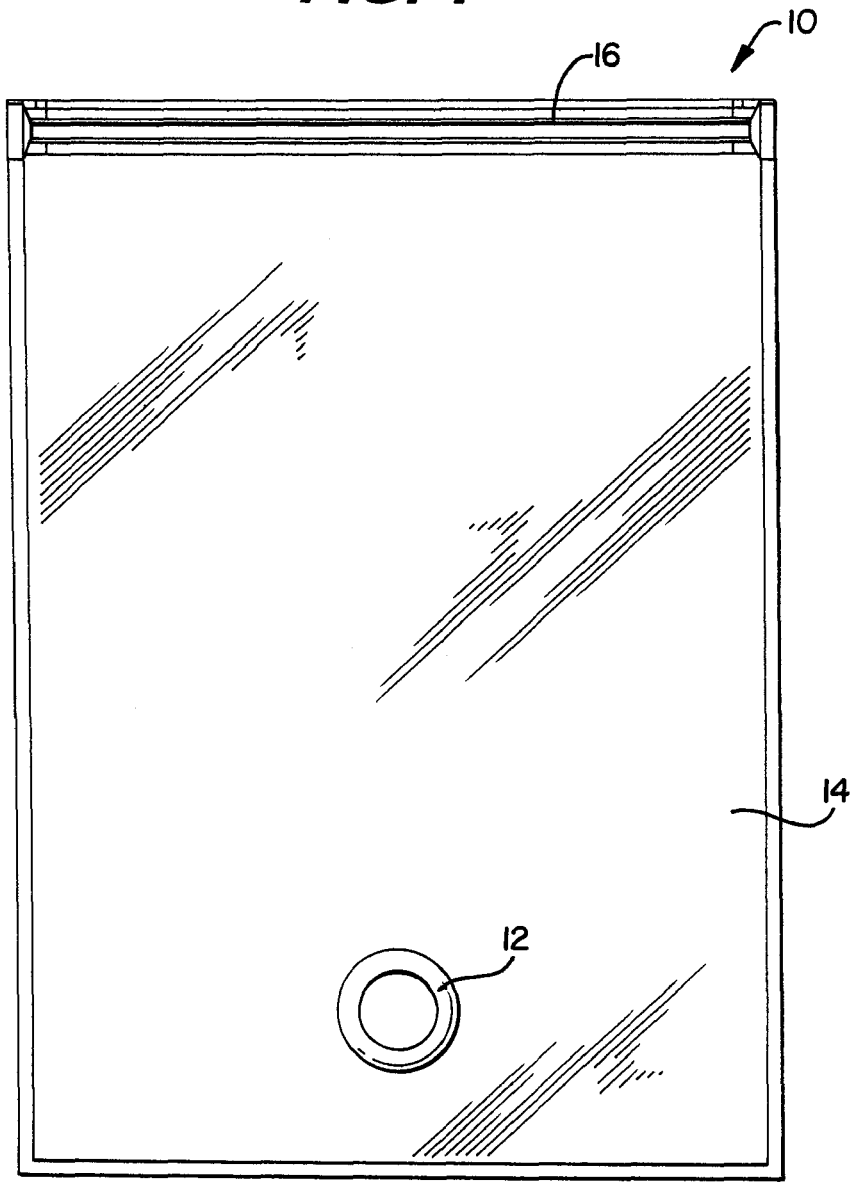
FIG. 1 is a perspective view of a container and closure assembly of the present invention with the container being in a sealed position.

While this invention is susceptible of embodiment in many different forms, there is shown in the drawings, and will be described herein in detail, specific embodiments thereof with the understanding that the present disclosure is to be considered as an exemplification of the principles of the invention and is not intended to limit the invention to the specific embodiments illustrated.

Figure 2:
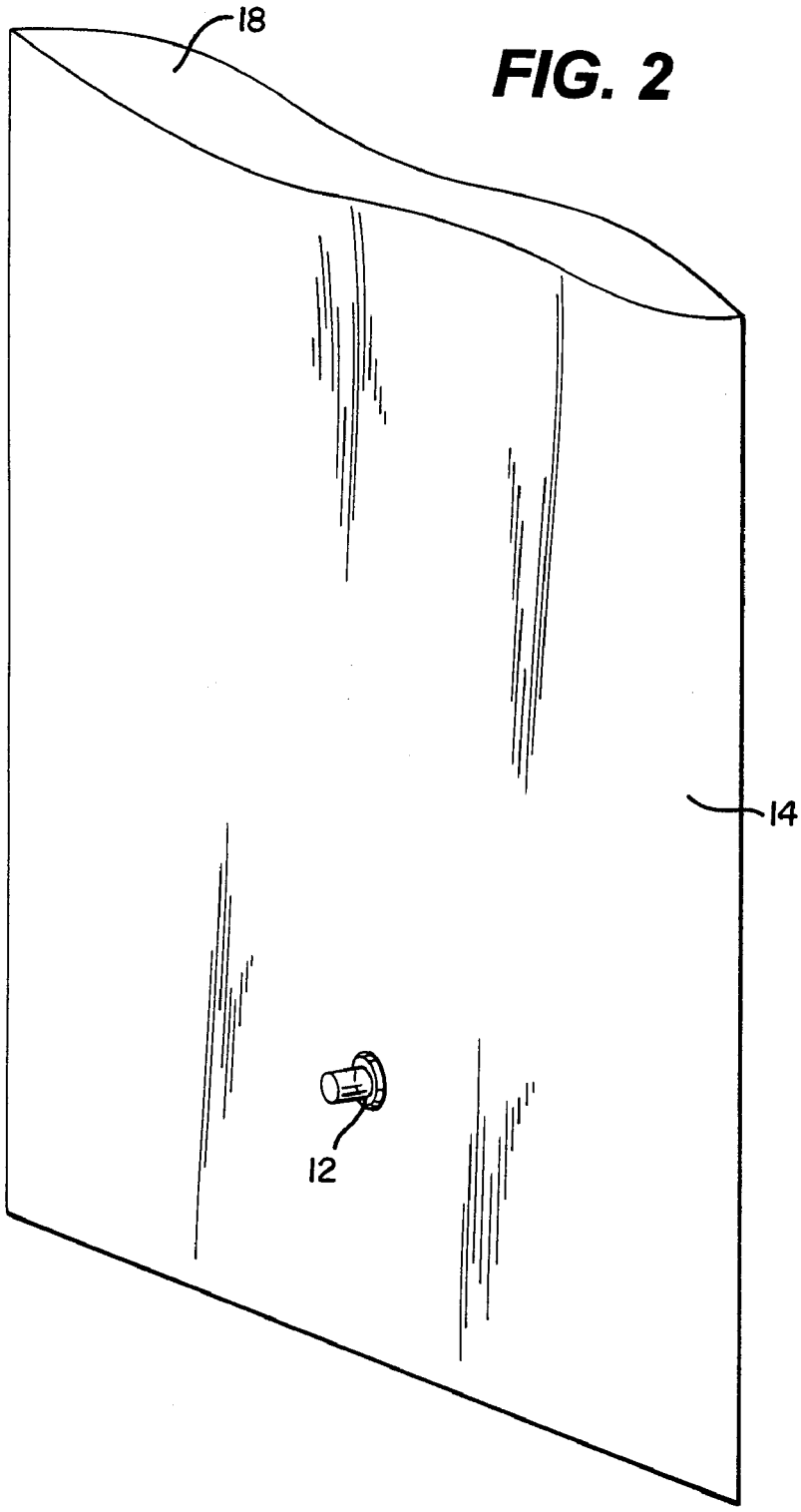
FIG. 2 is a perspective view of a container and closure assembly of the present invention with the container being in an unsealed position.
Figure 7:
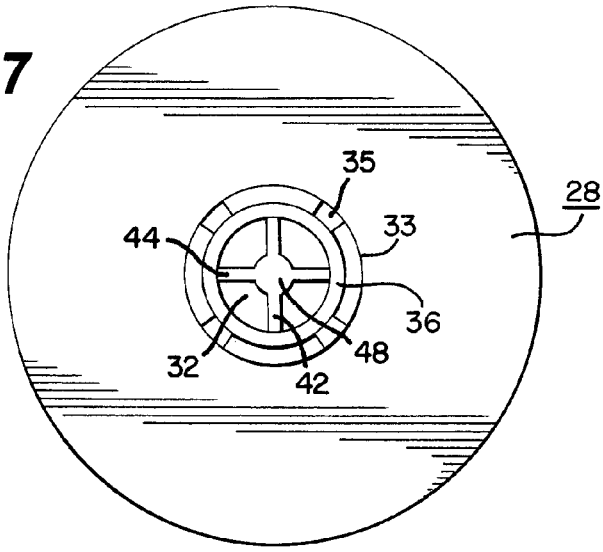
FIG. 7 is a top view of a valve of the present invention.
Figure 8:
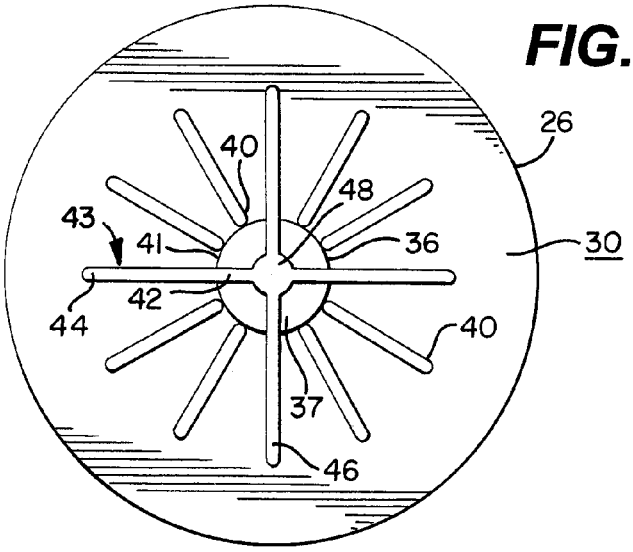
FIG. 8 is a bottom view of a valve of the present invention.

FIGS. 1 and 2 show a container system 10 having a closure assembly 12 and a container 14. The closure assembly includes a one-way valve that allows for evacuation of fluid from the container but does not allow a significant quantity of fluid to enter the container through the assembly 12. In one preferred form of the invention, the container 14 is capable of being opened and closed repeatedly without the use of a tool or heat source by utilizing a zipper 16 or other member for sealing an end of the container. FIG. 2 shows the container in an unsealed position with an opening 18 at an end of the container for loading articles into the container. The container is suitable for storing compressible articles sealed from the surrounding environment and maintaining a fluid tight seal. Excess fluid in the container can be removed by applying a suction to the closure assembly using a household vacuum cleaner or other suction device. Excess fluid can also be removed by pressing the sidewalls of the container to force fluids from the container or by rolling up the container or by applying pressure to the sidewalls in any fashion to remove excess fluids through the closure assembly. Thus, the use of a suction device to remove fluid from the container is optional. Removal of excess fluid reduces the size of the compressible article and by maintaining a minimal fluid content, such as air and water, inhibits the growth of insects, mold, mildew and other bacteria, which may damage the contents of the container. Moreover, in a preferred form of the invention, the sealed container and closure assembly provide a barrier to the passage of fluids to further inhibit the growth and propagation of bacteria, mold and mildew among other organisms over an extended period of time.

FIGS. 3, 4, 7 and 8 show the closure assembly 12 having a valve body 20, a plunger 22 and a diaphragm 24. FIG. 3 shows the closure assembly 12 in a closed position and FIG. 4 shows the closure assembly in an open position. The valve body 20 has an annular flange 26 having a first surface 28 and an opposed second surface 30, a centrally disposed opening 32 through the flange, and a cylindrical wall 33 extends from the first surface and is disposed circumjacent the opening 32 and defines a first fluid pathway 34 therethrough. The first cylindrical wall has a plurality of circumferentially spaced openings 35.

A second cylindrical wall 36 extends from the second surface 30 and has a fluid inlet 37 at a distal end and defines a second fluid pathway 38 therethrough that is in fluid communication with the opening 32. The fluid inlet 37 is sealed by the diaphragm 24 when the closure assembly is in the closed position and is uncovered when the closure assembly is in the open position. The second cylindrical wall 36 is circumferentially surrounded by a plurality of radially extending and circumferentially spaced fins 39 (See also FIG. 8) each of which have an end 40 terminating at an outer periphery 41 of the second cylindrical wall 36.

A valve supporting surface 42 is positioned in a generally central portion of the second fluid passageway and has a generally cruciform shaped member 43 having a first arm 44 a second arm 46 transverse to the first arm and has a generally circular platform 48 joining the first arm to the second arm. The valve supporting surface 42 extends across the entire diametrical dimension of the second cylindrical wall 36 and extends from the second surface 30 beyond a distal end 49 of the wall. The fins and the cruciform shaped member add rigidity to the valve assembly and reduce the tendency for the fluid inlet 37 to become closed or partially closed by the sidewalls of the container or by articles within the container.

In a preferred form of the invention, the valve body 20 is fabricated from a polymeric material by an injection molding technique. Suitable polymeric materials for the valve body include polymers, copolymers and terpolymers fabricated from one or more chemical groups including olefins, dienes, amides, esters, vinyl chlorides, vinyl alcohols, vinyl acetates, urethanes, imides, ethers, sulfones, styrenes, acrylonitrile, acrylates, substituted acrylates, and blends of polymers, copolymers and terpolymers derived from these chemical groups. In one preferred form of the invention the valve body is fabricated from the terpolymer acrylonitrile-butadiene-styrene or from the homopolymer polypropylene, or from a copolymer of propylene with minor proportions, say less than 6% by weight, of ethylene.

FIGS. 5 and 6 show the plunger 22 having a generally cylindrical shaped wall 50 defining a central fluid pathway 51. The plunger 22 has a flange portion 52 and a stem portion 54. FIG. 6 shows the flange portion includes several circumferentially spaced knobs 56 for hand gripping. The stem portion 54 extends coaxially within the valve body and has a set of threads 58 for cooperative engagement with mating threads 60 in the valve body 12. In a preferred form of the invention, the threads are coarse for moving the plunger between a first position shown in FIG. 3 to a second position shown in FIG. 4 with less than one complete 360° rotation of the plunger.

It is contemplated that instead of threads, the plunger could have a flange or protuberance that would cooperatively engage a flange or protuberance in the valve body to allow the plunger to slide within the valve body without becoming disassembled. Such a plunger could be moved from the first position to the second position when a vacuum is applied. It is also contemplated there could be a first stop that releasably holds the plunger in the first position and a second stop that releasably holds the plunger in the second position.

Figure 9:
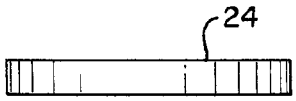
FIG. 9 is a side view of a diaphragm of the present invention.
Figure 10:
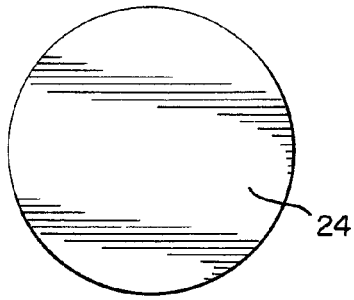
FIG. 10 is a top view of a diaphragm of the present invention.

FIGS. 9 and 10 show the diaphragm 24 which is dimensioned to fit within the valve body and has a generally uniform thickness across its entire diametric dimension. The diaphragm is moveable from a third position to a fourth position shown respectively in FIGS. 3 and 4 when the plunger is in the first position. When the diaphragm is in the third position it cooperates with the plunger to block the fluid inlet 37 and when the diaphragm is in the fourth position fluid is allowed to flow through the fluid inlet 37 and the fluid passageways 35. The diaphragm is preferably fabricated from a material that has a density that allows it to be moved in response to a suction applied to the valve body. Suitable materials for the diaphragm include paper, plastic, rubber, cork or metal. In another preferred form of the invention, the diaphragm will have a density of less than about 1.2 g/cc. In yet another preferred form of the invention, the diaphragm will be fabricated from silicone or polyvinyl chloride.

In a preferred form of the invention, the zipper closure 16 is constructed in accordance with commonly assigned U.S. Pat. No. 6,033,113 or U.S. Patent Application No. 2004/0091179A1 each of which is incorporated herein by reference and made a part hereof. The zippered closure is typically made of plastic. Often associated with the zippered closure is a slider that facilitates sealing the zippered closure. The slider closes and can open the zippered closure. Examples of sliders include those disclosed in U.S. Pat. Nos. 6,854,887; 6,306,071; 6,287,001; 6,264,366; 6,247,844; 5,950,285; 5,924,173; 5,836,056; 5,442,837; 5,161,286; 5,131,121; 5,088,971; and 5,067,208 each of which is incorporated herein by reference and made a part hereof.

The container 14 can be rigid, semi-rigid or flexible and, in a preferred form of the invention, should be capable of being sealed to form a fluid tight chamber. The container 14 can be permanently sealed or, as is shown in FIGS. 1 and 2, can be capable of being closed and reopened. What is meant by the term "flexible" is the material used to fabricate the container will have a mechanical modulus when measured according to ASTM D-882 of less than 40,000 psi. The term "semi-rigid" will refer to materials having a mechanical modulus of from 40,000 psi to 100,000 psi. The term "rigid" will refer to materials having a mechanical modulus of greater than 100,000 psi.

For containers that are permanently sealed fluid can be delivered to the container through an access member such as a tube, port, valve, spout, fitment or the like. The access member can remain with the container after filling or can be removed by any suitable method such as by a hot knife or other cutting member. The term "fluid" refers to liquids or gasses.

The container 14 can be fabricated from metal, paper, and plastic. Suitable plastics include the polymers set forth above for the valve body. The container can be fabricated from a monolayer film, a multiple layer film or from more than one ply of material where a portion of the plies are sealed together but the individual plies are not joined across their entire surface area. It is contemplated the container can be fabricated from a multiple layer structure having one or more layers of polymeric materials and one or more layers of paper or metals. Metals such as aluminum are known to provide significant barriers to water vapor transmission and to the transmission of gasses such as oxygen, nitrogen, helium, hydrogen and others. Also, polymers such as ethylene vinyl alcohol and polyamides are commonly used as they also provide significant barrier properties. Containers can be constructed from a single web of material that is folded, from two webs of material or by a blown extrusion or blow molding or other polymer processing techniques that are well known in the art.

A method of fabricating the container assembly 10 shown in FIGS. 1 and 2 includes the steps of providing a container, making a hole in the container dimensioned to fit the valve body 12, inserting the valve body 12 into the hole with the second surface 30 extending into the chamber of the container and the flange 26 contacting an outside surface of the container and providing heat directly or indirectly to the flange to weld the flange and valve body 12 to the container.

The container 14 can be evacuated of fluids by first moving the plunger from the first position to the second position either by rotating the plunger, sliding the plunger or the like, then applying a suction through a hose or the like using a household vacuum cleaner or other device such as a pump that is capable of generating a suction to remove fluid from the container through the valve body. Upon applying the suction the diaphragm is free to move from the third position to the fourth position where fluid can flow through the fluid passageways 35 and out of the container. Excess fluids can also be removed by pressing onto the sidewalls of the container to force air out of the container through the closure. After evacuation is complete, the suction should be removed or the pressing on the sidewalls should be discontinued. The diaphragm will be moved by gravity or by suction caused by the reduced pressure environment inside the container to partially or fully close the fluid passageway 37. The plunger should then be moved back to the first position to maintain a fluid tight seal by locking the diaphragm in the third position.

FIGS. 11*a-f* show alternative embodiments of the container system 10. The container shown in FIGS. 11*a-e* are suitable for use in packaging liquid, solid or particulate food items 62 in addition to being suitable for packaging the compressible articles mentioned above. The container can be permanently sealed along all edges after the container is filled with the desired contents or the container can be provided with a recloseable member to allow for opening and closing of the member and more preferably for repeated opening and closing of the member and in a preferred form of the invention the recloseable member will be positioned along an edge of the container.

The container 14 has a peripheral seal 75 along three edges of the container and has a recloseable member, which in a preferred form of the container is a zipper 77, at a fourth edge. The recloseable member is optional and it is contemplated this fourth edge 82 could be initially unsealed and later sealed, by, for example, direct or indirect heating, after placing or filling contents into a chamber 78 of the container. It is contemplated the fourth edge could also be sealed with a different type closure mechanism, such as a clamp, clasp, fastener, cap or by an adhesive, by electrostatic adhesion or other method so long as it is capable of maintaining an airtight seal under the condition in which the container is subjected during normal usage.

The containers of FIGS. 11*a-d* further have a structure for isolating the closure assembly 12 from the contents 64, or the chamber 78, to allow air to flow from the chamber 78 through the closure assembly 12 without evacuating the stored contents 64 of the chamber. In a preferred form of the invention, the isolating structure is a supplemental seal 79 formed by joining the two sidewalls together along the seal line 79. As shown in FIGS. 11*a-d*, the supplemental seal 79 surrounds a portion of the closure assembly 12 and provides a fluid pathway 80 from the chamber 78 to the closure assembly 12.

In a preferred form of the invention, the supplemental seal 79 is a permanent seal that cannot be separated without damaging the container. It is further contemplated the supplemental seal can be a peel seal capable of being opened by a user of the container. Further, the supplemental seal 79 can be a narrow seal, as is shown in FIGS. 11*a-d*, or can be of greater width to add strength, or to provide another function, to the supplemental seal or to the container or to both. It is further contemplated the supplemental seal 79 can be formed by providing a strip or web of material that is attached at opposed portions thereof to extend between the two sidewalls to form an internal wall within the chamber 78.

Figures 11A, 11B, 11C, 11D, 11E, 11F:
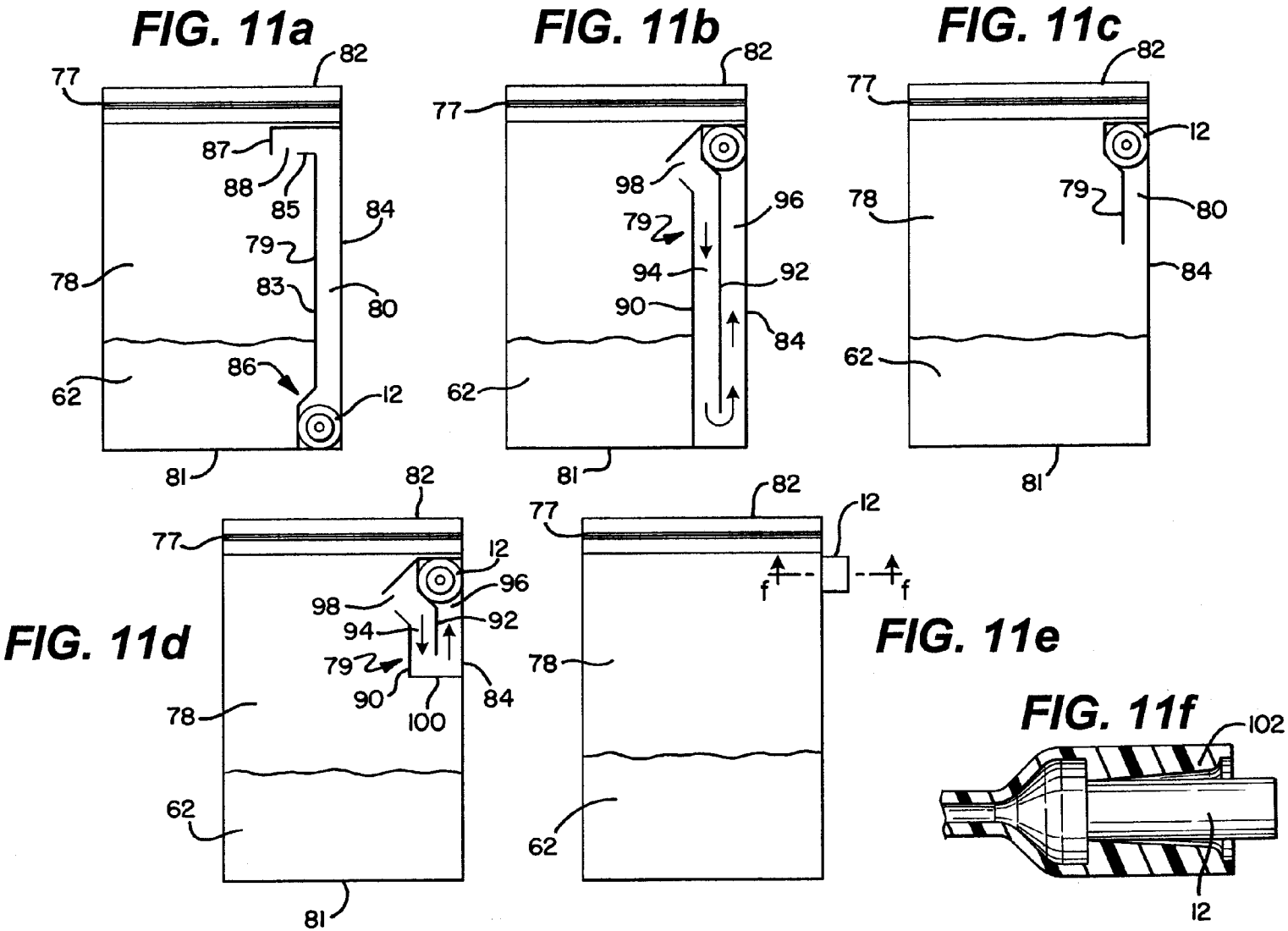
FIGS. 11*a-e* are top plan views of alternative embodiments of container systems of the present invention.
FIG. 11*f* is a view in partial cross-section along line f-f of FIG. 11*e;*

FIG. 11*a* shows the supplemental seal 79 extending from the bottom edge 81 and terminating short of the top or fourth edge 82. A first intermediate portion 83 of the seal 79 extends in a direction generally parallel to the lateral edges 84 and a second portion 85 extends from the first portion 83 in a direction transverse thereto. A third portion 86 surrounds the closure assembly 12, which is positioned proximate the bottom edge 81 of the container, and tapers outwardly toward the lateral edge to reduce the width of the fluid pathway from a full diameter of the closure to a reduced width. A second supplement seal 87 is generally L-shaped and together with the first seal 79 cooperate to define a fluid opening 88 connecting the chamber 78 to the fluid pathway 80. The fluid pathway 80 is also generally L-shaped and may sometimes be referred to as a tortuous path. What is meant by the term "tortuous" path is a path that has a twist, turn or curve.

FIGS. 11*b* and 11*d* show an alternative embodiment of the supplemental seal 79 having a first seal 90 and a second seal 92 defining a first fluid pathway 94 between the first and second seals 90, 92 and a second fluid pathway 96 between the second seal 92 and the adjacent lateral edge 84. An opening 98 is provided to the first fluid pathway 94 to allow air to flow in the direction of the arrows in opposite directions in the first and second fluid pathways. In the embodiment shown in FIG. 11*b*, the bottom edge 81 of the container forms a terminal edge of the first pathway 94 and in the embodiment shown in FIG. 11*d* a seal line 100 forms a terminal edge of the first pathway 94.

FIG. 11*c* shows yet another embodiment of the supplemental seal 79 having a single seal line defining the fluid pathway 80 between the supplemental seal 79 and the adjacent lateral edge 84. In this embodiment the closure assembly 12 is positioned proximate the top edge 82 of the container. Thus, it should be clear that the closure assembly 12 can be positioned in numerous locations in the container provided it is capable of being isolated from the contents.

While the embodiments shown in FIGS. 11*a-d* show the closure assembly 12 extending essentially perpendicularly from a planar surface of a sidewall of the container, it is contemplated the closure could extend in a direction other than perpendicularly including in a direction essentially parallel to the planar surface. A portion of the closure assembly can extend between the sidewalls and be sealed therebetween or a hole can be removed from a portion of one of the sidewalls or a gusset in the sidewall and be sealed to the wall.

FIGS. 11*e* and 11*f* show the container could have a gusset 102 along a portion of the length or width of the container and have the closure assembly 12 positioned within the gusseted portion. The closure extends in a direction generally parallel to the planar surface of the sidewalls.

It is contemplated the supplemental seam 79 could be replaced with a tubing that is connected in fluid communication with the closure assembly 12 and the tubing extends to a position above the point the food item will be stored so that an opening in the distal end of the tubing will not evacuate the stored item.

In a preferred form of the invention, an inner surface of one or both sidewalls will have a textured inner surface, contents contacting, forming fluid evacuation passages. The passages will allow fluid to flow through the passages even when the sidewalls are in face to face contact with one another.

Figure 12:
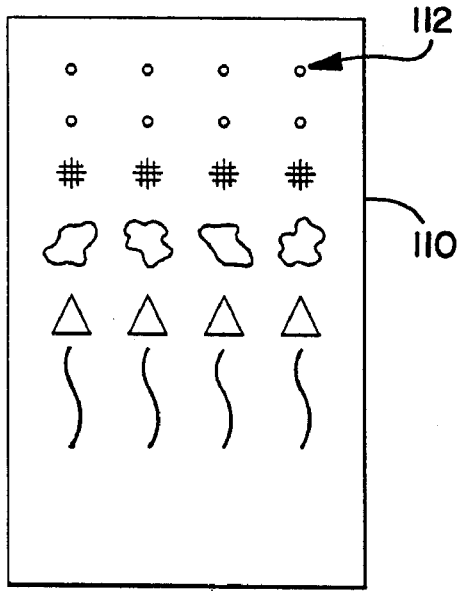
FIG. 12 is plan view of a sidewall of a container having objects having varying shapes on a planar surface.

FIG. 12 shows a film structure 110 suitable for forming a sidewall of the containers described herein and having a plurality of objects 112 on a planar surface thereof. In a preferred form of the invention, the objects 112 are positioned on a first surface that will form an interior or fluid contacting surface of the sidewall of the container. However, it is contemplated, a surface that will form an exterior surface of a sidewall of the container could have the textured pattern or both the interior and exterior surfaces of a sidewall of the container could have the textured pattern. The objects 112 can be positioned on a single sidewall or both sidewalls of the container. The objects, in a preferred form of the invention, are provided over substantially an entire planar surface of the sidewall but could also be provided only in select areas of the sidewall without departing from the scope of the invention. The objects can be of any shape including regular shapes such as circular, polygonal, straight or curved lines, symbols or the like. The objects can also be irregular or amorphous in form. The objects 112 can be raised protuberances or indentations in these shapes. The objects on one sidewall can also be different from the objects on the opposing sidewall. The objects 112 can be all of the same shape or can be of any combination of varying shaped objects. In one form of the invention, the objects 112 can be positioned to extend in a line extending longitudinally, lattitudinally, diagonally of the sidewall or a combination of the same. The objects 112 can be of varying sizes provided the objects are effective to provide fluid pathways through the container as excess air is being evacuated.

The objects 112 can form a regular pattern or an irregular pattern. The regular pattern includes objects being placed at the same or essentially the same spacing or a repeating sequence of spacings. The irregular pattern is one where the objects are generally randomly distributed.

Figure 13:
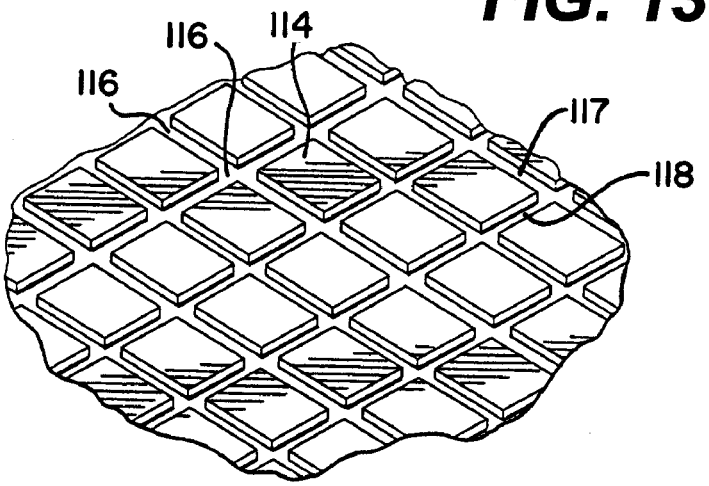
FIG. 13 is a plan view of a sidewall of the container of FIG. 11 having a plurality of regularly spaced rectangular protuberances to define a checkerboard pattern.

In a preferred form of the invention as shown in FIG. 13, a regularly spaced pattern of rectangular-shaped or square-shaped objects 114 having pathways 116 defined therebetween. This checkerboard pattern has at least a first pathway 117 intersecting a second pathway 118. In a preferred form of the invention, the first pathway intersects the second pathway at a substantially right angle, or the first pathway extends in a direction essentially perpendicular to the second pathway. However, it is contemplated the intersection of pathways can form various angles without departing from the scope of the present invention.

Figure 14:
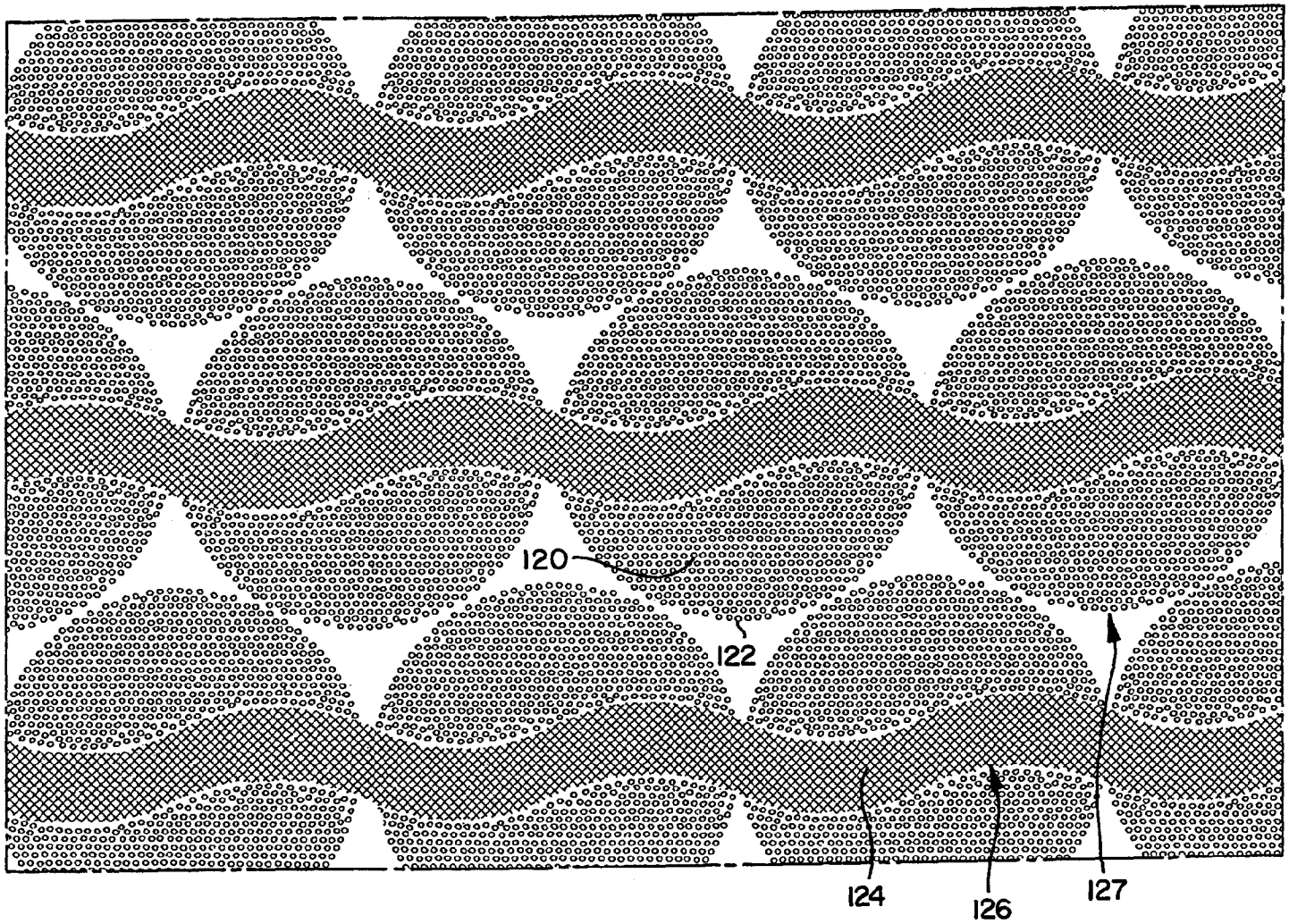
FIG. 14 is a plan view of a sidewall having circular protuberances together forming a circular pattern with a series of X-shaped protuberances forming S-shaped lines.

FIG. 14 shows another preferred form of the invention having a plurality of circular protuberances 120 grouped together with X-shaped protuberances 124 on a sidewall. The circular protuberances 120 are grouped to define a circular shape 122 pattern. The X-shaped protuberances 124 are grouped to define a repeating S-shaped pattern 126. The x-shaped pattern is positioned within the circular shaped 122 pattern to define a sum object 127. The sum object 127 is shown to be a company logo 127 but could also be other indicia such as a trademark, a tradename, instructions for use of the film or object made from the film or other identifying or useful information or advertising that can be viewed through one of the sidewalls or both.

A plurality of sum objects 127 are shown connected together to define a web of interconnected sum objects 127. It is contemplated that the sum objects 127 could be positioned in other relationships and other patterns without departing from the scope of the invention. Of course it is also contemplated that any combination of shapes of protuberances can be used and that more than two different shapes can be used together to form patterns of various shapes and sizes.

Figure 15:
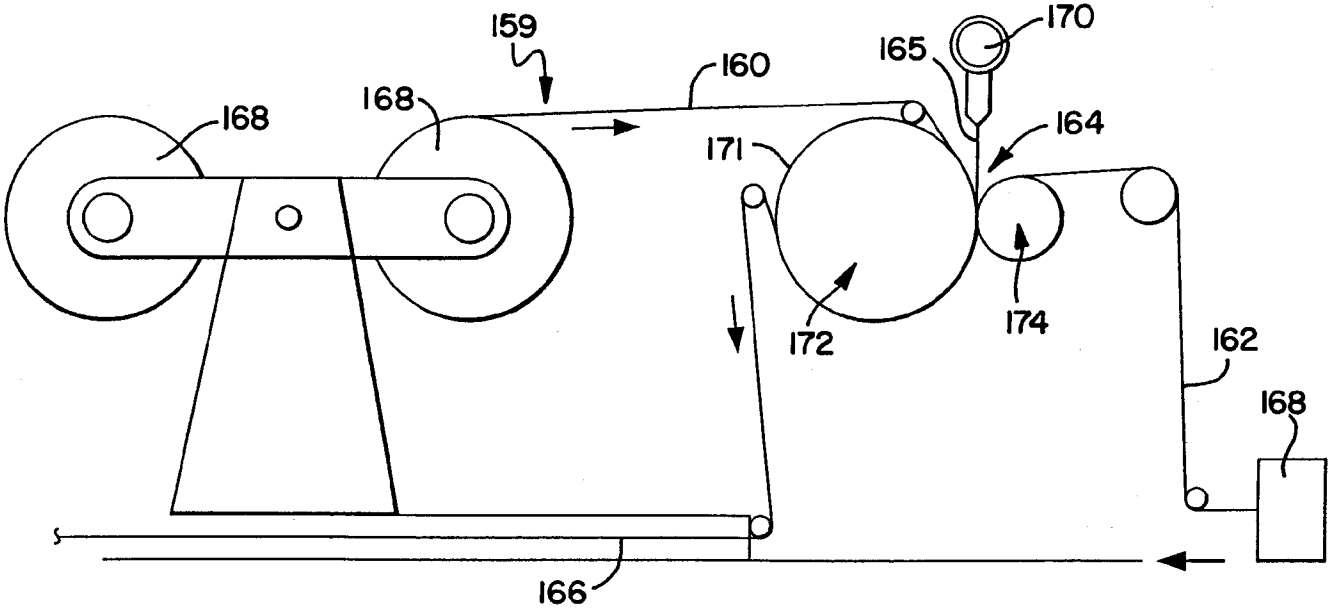
FIG. 15 is a schematic view of a process for texturing a surface of a film.

FIG. 15 shows a texturing station 159 for imparting the pattern on the film. The method comprises the steps of: (1) providing a first sheet of material 160, (2) providing a second sheet of material 162, (3) positioning the first sheet 160 or the second sheet 162 to overlap at least a portion of the other sheet to define an interference zone 164, (4) directing a first polymeric material 165 into the interference zone 164 to adhere the first sheet 160 to the second sheet 162 to form a layered structure 166 (FIG. 16), and (5) texturing a surface of the first sheet or the second sheet to form a pattern on the surface.

In a preferred form of the invention, the first sheet and the second sheet are polymeric films as described above. However, it is contemplated that the first sheet and/or the second sheet could be selected from paper or metal foil provided that one of the layers is capable of maintaining the pattern during regular use of the layered structure 166.

The first sheet 160 can be a monolayer structure or a multiple layered structure as set forth above. The monolayer structure can be of a polymer blend of the polymeric components. The multiple layered structure can have a layer or more than one layer of a polymer blend of the polymeric components. In one preferred form of the invention the first sheet is a film having a layer of a polyolefin and more preferably an ethylene and $\alpha$-olefin copolymer, and even more preferably is an LLDPE. Such a first sheet having an LLDPE layer has been found to be well suited to form a seal layer or innermost layer of the container 14 as LLDPE forms strong, durable seals.

In another preferred form of the invention, the first sheet 160 can also be a multiple layered polymeric structure having a first layer of a polyolefin and a second layer to provide additional attributes to the film such as scratch resistance, barrier to the transmission of gasses or water vapor or the like. Suitable materials to form a barrier material includes ethylene and vinyl alcohol copolymers, polyamides, polyesters, PVDC and metal foil to name a few. One preferred multiple layered film to form the first sheet 160 has a first layer of LLDPE and a second layer of ethylene vinyl alcohol copolymer.

The second sheet 162 is also preferably a monolayer polymeric film or a multiple layered polymeric film selected from the films and polymeric materials detailed above. In one preferred form of the invention, the second sheet 162 is a barrier material and more preferably a polyamide or polyester and even more preferably nylon 6. The first sheet 160 and the second sheet 162 can be preformed and provided on spooled rolls 168 or the sheets can be laminated or otherwise produced in line.

The step of positioning the first sheet 160 in an overlapping relationship with the second sheet 162 is accomplished using standard polymeric sheet handling machinery. In a preferred form of the invention, either the first sheet 160 is positioned with respect to the second sheet 162, or the second sheet 162 is positioned with respect to the first sheet 160 or both sheets are positioned with respect to one another so that in any instance the peripheries of the first and second sheet are essentially in complete registration.

The step of directing the first polymeric material 165 into the interference zone 164 to adhere the first sheet 160 to the second sheet 162 to form the layered structure 166 can be carried out by flowing polymeric material in a molten form into the interference zone 164. Molten polymeric material can be provided under pressure to the interference zone 164 using an extrusion die 170. The polymeric material may be extruded as a single polymeric material or a blend of polymeric materials. The polymeric material may also have multiple layers coextruded from a coextrusion die. It is also contemplated that the first polymeric material can be an adhesive that can be sprayed or otherwise spread or distributed into the interference zone 164. In a preferred form of the invention, the first polymeric material is a polyolefin and more preferably, an ethylene homopolymer and even more preferably a LDPE.

The step of texturing the film can include the step of imparting a desired pattern described above onto the first sheet 160 or the second sheet 162 or both. The step can be carried out prior to the step of joining the sheets together, substantially or essentially simultaneously with the step of adhering the first and second sheets together, as shown in FIG. 15, or after the step of adhering the first sheet to the second sheet. In a preferred form of the invention, the step of texturing is carried out substantially simultaneously with the joining step.

The step of texturing the film includes the step of bringing the sheet or layered structure to be textured into cooperative engagement with a surface having the desired pattern thereon. In a preferred form of the invention, the surface 171 is located on a roll and more preferably a chill roll 172. The chill roll 172 can be fabricated from any suitable material such as metal, plastic or cork. The chill roll 172 can have the pattern extending inward of its outer surface or can extend outward from its outer surface. The sheet or structure is held in cooperative engagement against the chill roll 172 using a back-up roll 174. The back-up roll 174 can be made from metal, rubber, plastic or paper and most preferably rubber. It should be understood that either the chill roll 172, the back-up roll 174 or both can carry the pattern.

After the layered structure 166 passes the chill roll, it proceeds along to a spooling station or to be fabricated into useful objects like the container 14.

Figure 16:
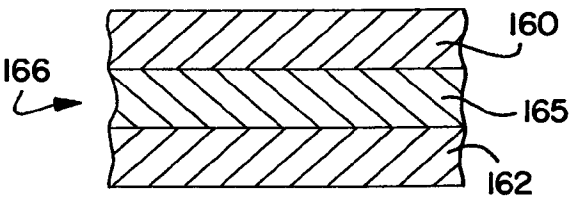
FIG. 16 is a cross-sectional view of a multiple layered film having a textured surface.

FIG. 16 shows the layered structure 166 having the first sheet 160 joined to the second sheet 162 by polymeric material 165. Objects 112 are shown on the first sheet 160 but could be positioned on sheet 162 or both sheets 160 and 162 without departing from the present invention.

Figure 17:
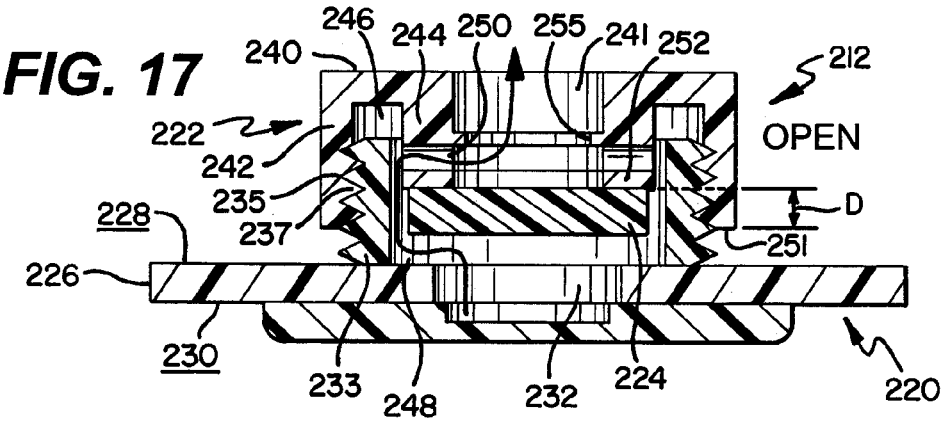
FIG. 17 is a side elevational view of an alternative embodiment of a closure assembly of the present invention in the open position.
Figure 18:
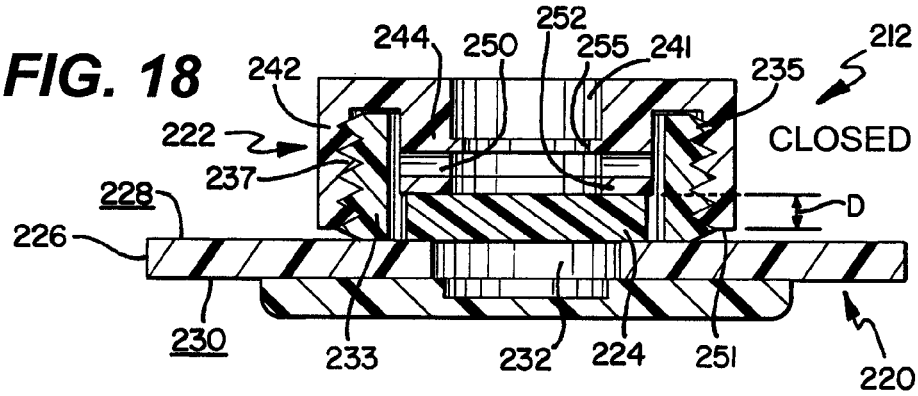
FIG. 18 is a side elevational view of an alternative embodiment of a closure assembly of the present invention in the closed position.

FIGS. 17 and 18 show an alternative embodiment of the closure assembly 12 from the one shown in FIGS. 1-10. Any references to the closure assembly or valve 12 or 212 herein should be taken to mean any closure assembly or valve disclosed herein, that is, any closure assembly can be used with any container.

Figure 19:
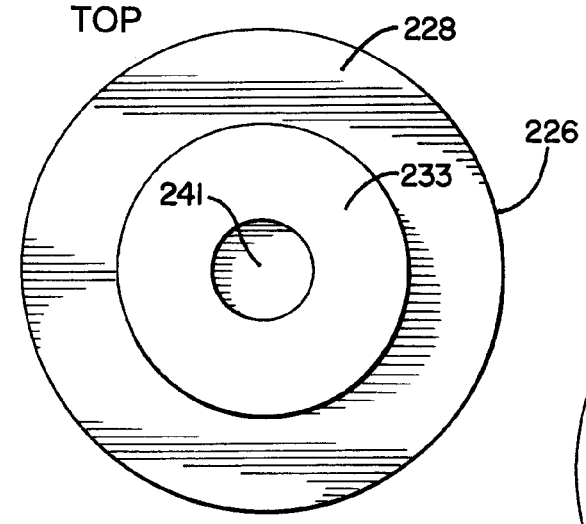
FIG. 19 is a top view of the closure assembly of FIG. 18.

The closure assembly 212 shown in FIGS. 17 and 18 has a valve body 220, a threaded cap 222 (See also FIG. 19) and a diaphragm 224. FIG. 17 shows the closure assembly 212 in an open position and FIG. 18 shows the closure assembly in a closed position. The valve body 220 has an annular flange 226 having a first surface 228 and an opposed second surface 230, a centrally disposed opening 232 through the flange, and a cylindrical wall 233 extends from the first surface and is disposed circumjacent the opening 232. The threaded cap and the cylindrical wall each have a set of mating threads to move the assembly from an open position to a closed position. The threaded cap has a diaphragm contacting surface to press the diaphragm against the opening 232 when the assembly is in the closed position.

The cylindrical wall 233 has a first set of threads 235 on a surface, and preferably on an external surface, for mating with a second set of threads 237 positioned on a surface of the threaded cap and preferably on an internal surface of the threaded cap 222. Thus, the threaded cap is mounted to the cylindrical wall 233 and is moveable by rotation from an open position to a closed position. It is contemplated the threads 235 could be positioned on an internal surface of the cylindrical wall 233. It is also contemplated the second set of threads 237 could be located on an exterior surface of the threaded cap 222.

In a preferred form of the invention, the threaded cap 222 has a top surface 240, a centrally disposed fluid exit 241, a first annular wall 242 and a second annular wall 244 each spaced axially from the fluid exit 241 and having an annular space 246 positioned between the first and second annular walls. The annular space 246 is dimensioned to receive the cylindrical wall 233 and to provide a fluid pathway 248. As shown in FIGS. 17 and 18, an inner surface of the first annular wall 242 carries the second set of threads 237 for threadably connecting the threaded cap to the cylindrical wall 233. However, it is contemplated the second set of threads could be positioned elsewhere such as on an exterior surface of the first annular wall 242 or on an exterior surface of the second annular wall 244 or on an interior surface of the second annular wall.

Thus, as shown in FIGS. 17 and 18, the threaded cap 222 has the second set of threads on an internal surface of the first annular wall 242 for mating with the first set of threads on an exterior surface of the cylindrical wall 233. However, the present invention further contemplates positioning the second set of threads on an exterior surface of the second annular wall (adjacent the annular space 246) for mating with the first set of threads positioned on an interior surface of the cylindrical wall. It is further contemplated the second set of threads could be positioned on an interior surface of the second annular wall (adjacent the fluid exit 241) for mating with the first set of threads positioned on an exterior surface of the cylindrical wall. It is also contemplated the second set of threads could be positioned on an exterior surface of the first annular wall 242) for mating with the first set of threads positioned on an interior surface of the cylindrical wall wherein the second annular wall is optional or could serve as the diaphragm contacting surface.

Further shown in FIGS. 17 and 18, the second annular wall 244 has a through hole 250 connecting the fluid pathway 248 to the fluid exit 241 when the closure assembly is in the open position (FIG. 17). In a preferred form of the invention, the through hole 250 extends radially of the threaded cap and in a line transverse to an axis of the opening 232. A distal end or diaphragm contacting portion 251 of the first annular wall extends a distance "D" beyond a distal end 252 of the second annular wall and preferably the distance "D" is equal to or less than a thickness of the diaphragm so that the diaphragm is held in fluid tight engagement with the valve support surface 254 to seal the opening 232.

An annular tubing stop 255 is provided extending radially inwardly from the second annular wall 244 and is positioned adjacent the through hole 250 to prevent a tubing from a pump or other suction device from clogging the through hole 250 during evacuation of excess air from the container.

Figure 20:
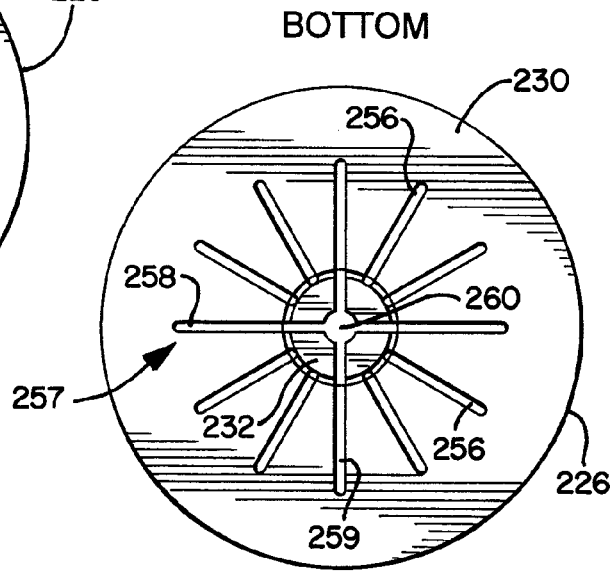
FIG. 20 is a bottom view of the closure assembly of FIG. 18.

FIG. 20 shows a plurality of radially extending and circumferentially spaced fins 256 extending from surface 230 of the annular flange 226 and positioned circumjacent opening 232. A cruciform shaped member 257 also extends from the surface 230 having a first arm 258 a second arm 259 transverse to the first arm and has a generally circular platform 260 joining the first arm to the second arm. The cruciform shaped member 257 and the radially extending flanges 256 prevents blockage of the opening 232, by a sidewall or by other object, during evacuation of the container.

In a preferred form of the invention, the valve body 220 and the threaded cap 222 of the closure assembly 212 can be fabricated from a polymeric material as described above for the valve body 20. The diaphragm 224 is made from the same material and is similarly dimensioned as the diaphragm 24 shown in FIGS. 9 and 10.

Figure 21:
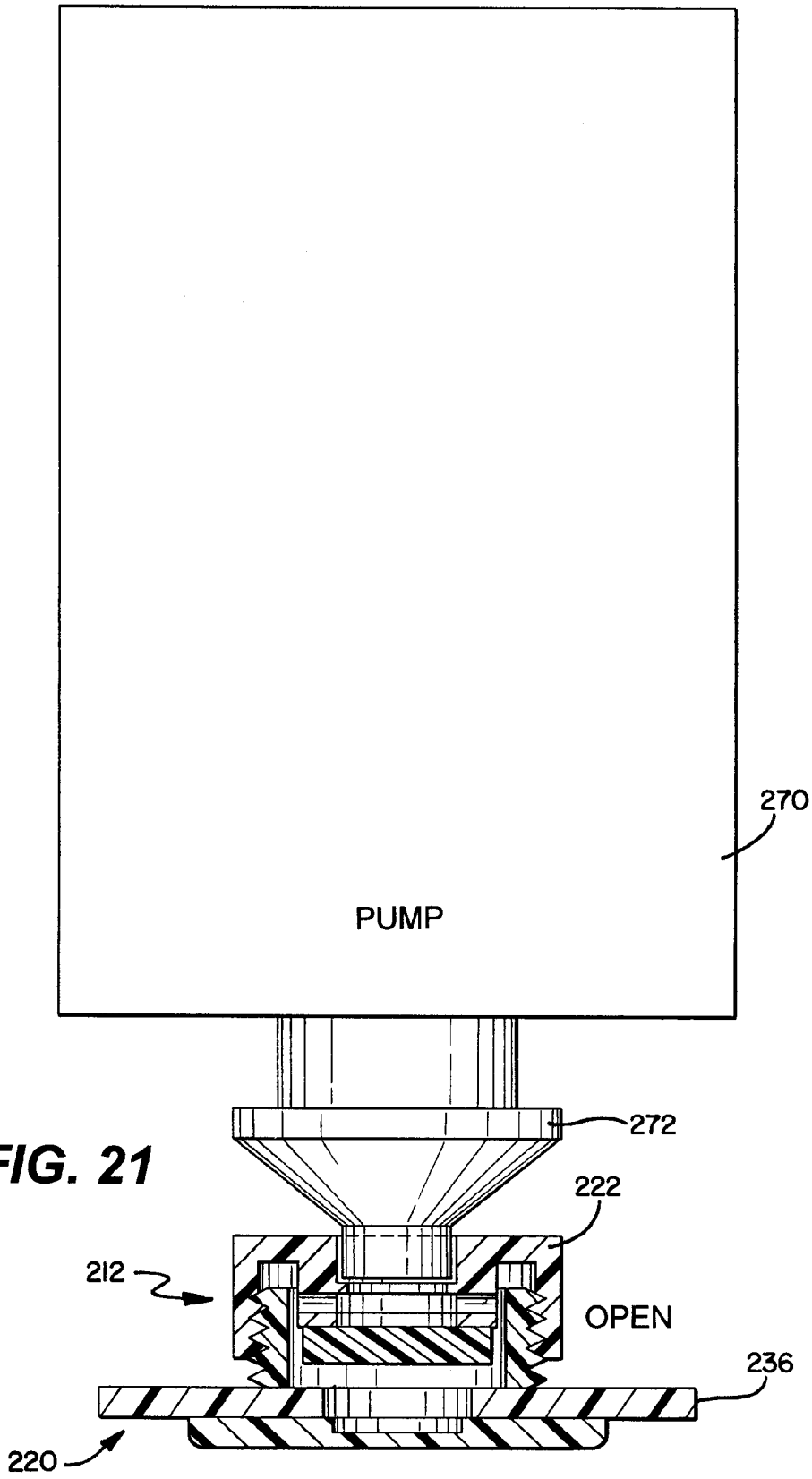
FIG. 21 is a schematic view of a closure assembly docked to a pump.

FIG. 21 shows a pump 270 connected by a fluid pathway 272 to the closure assembly 212. The pump is used to evacuate excess air and other undesired fluids from the container without evacuating the contents from the container. In this air sealed package the contents, when they are food articles, can be preserved for a longer period of time than other food containers where the excess fluid is not evacuated. Suitable pumps include an electric pump, a battery driven pump, a hand or foot operated pump or the like. It is also contemplated creating a suction using a tubing where suction is created in a leg of the tubing connected to the closure assembly by running water through a second leg of the tubing from a water source, such as a household water faucet. In a preferred form of the invention the pump is capable of pulling a vacuum of 5 to 10 inches of water. The fluid pathway 272 can be a length of tubing or can be a fitment on the pump for docking to the closure assembly.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A container assembly comprising:

a container having opposed sidewalls;

(a) a closure assembly connected to a sidewall, the assembly comprising:

a valve body having an annular flange attached directly to a planar surface of one of the opposed sidewalls of the container, a fluid opening through the flange, a cylindrical wall extends axially away from the annular flange and is positioned circumjacent the opening and has a first set of threads on a portion of an outer surface of the cylindrical wall;

(b) a diaphragm positioned within the cylindrical wall and dimensioned to cover the fluid opening; and (c) a threaded cap having a top surface, a fluid exit, a first annular wall and a second annular wall spaced from the first annular wall and defining an annular space therebetween, a diaphragm contacting surface, and a second pair of threads on an inner portion of the first annular wall, the threaded cap is mounted on the valve body with the cylindrical wall inside the annular space and by cooperative engagement of the first set of threads and the second set of threads, the threaded cap is moveable with respect to the valve body between an open position of the closure assembly where the first set of threads and the second set of threads are partially engaged to a closed position of the closure assembly where the first set of threads and the second set of threads are fully engaged and the cap is tightly engaged to the valve body and the diaphragm contacting surface presses the diaphragm against the opening of the valve body and fluid is blocked from escaping through the closure assembly.

2. The assembly of claim 1 wherein the closure assembly extends from a planar surface of one of the sidewalls.

3. The assembly of claim 2 wherein the closure assembly extends in a direction essentially perpendicular to the planar surface.

4. The assembly of claim 1 wherein at least one of the sidewalls has a texture on a portion of a planar surface.

5. The assembly of claim 4 wherein the texture has a plurality of objects.

6. The assembly of claim 5 wherein the objects extend above the planar surface.

7. The assembly of claim 6 wherein the objects extend below the planar surface.

8. The assembly of claim 7 wherein the objects define a first fluid pathway intersecting a second fluid pathway.

9. The assembly of 5 wherein the objects define a checkerboard pattern.

* * * * *